US011208606B2

(12) United States Patent
Sunagawa et al.

(10) Patent No.: US 11,208,606 B2
(45) Date of Patent: Dec. 28, 2021

(54) LUBRICATING OIL COMPOSITION, METHOD FOR PRODUCING LUBRICATING OIL COMPOSITION, AND CONTINUOUSLY VARIABLE TRANSMISSION

(71) Applicant: IDEMITSU KOSAN CO., LTD., Tokyo (JP)

(72) Inventors: Yoji Sunagawa, Sodegaura (JP); Takeshi Iwasaki, Chiba (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 0 days.

(21) Appl. No.: 16/979,314

(22) PCT Filed: Feb. 28, 2019

(86) PCT No.: PCT/JP2019/007904
§ 371 (c)(1),
(2) Date: Sep. 9, 2020

(87) PCT Pub. No.: WO2019/176569
PCT Pub. Date: Sep. 19, 2019

(65) Prior Publication Data

US 2021/0002572 A1 Jan. 7, 2021

(30) Foreign Application Priority Data

Mar. 13, 2018 (JP) ..... JP2018-045868

(51) Int. Cl.

| | |
|---|---|
| ***C10M 105/02*** | (2006.01) |
| ***C10M 105/34*** | (2006.01) |
| *C10N 20/00* | (2006.01) |
| *C10N 40/04* | (2006.01) |
| *C10N 30/02* | (2006.01) |

(52) U.S. Cl.
CPC ..... *C10M 105/02* (2013.01); *C10M 105/34* (2013.01); *C10M 2203/045* (2013.01); *C10M 2207/2805* (2013.01); *C10N 2020/067* (2020.05); *C10N 2020/071* (2020.05); *C10N 2030/02* (2013.01); *C10N 2040/045* (2020.05)

(58) Field of Classification Search
CPC ..... C10M 105/02; C10M 105/34; C10M 2203/045; C10M 2207/2805; C10M 105/04; C10N 2020/071; C10N 2040/045; C10N 2020/067; C10N 2030/02
See application file for complete search history.

(56) References Cited

U.S. PATENT DOCUMENTS

| | | | | |
|---|---|---|---|---|
| 6,187,979 | B1 | 2/2001 | Ido et al. | |
| 2004/0014617 | A1* | 1/2004 | Koga | C10M 111/04 508/463 |
| 2007/0042915 | A1* | 2/2007 | Yoshida | C07C 13/605 508/110 |
| 2013/0123553 | A1 | 5/2013 | Sekiguchi et al. | |
| 2015/0376544 | A1* | 12/2015 | Nakao | C10M 169/04 508/192 |
| 2016/0201002 | A1 | 7/2016 | Koga | |
| 2017/0145337 | A1* | 5/2017 | Masuda | C10M 135/36 |
| 2018/0016518 | A1* | 1/2018 | Kaneko | C10M 145/28 |
| 2019/0024004 | A1* | 1/2019 | Kuroda | C10M 101/02 |
| 2020/0199474 | A1* | 6/2020 | Hill, Jr. | C09D 7/63 |
| 2020/0208071 | A1* | 7/2020 | Sunagawa | C10M 105/38 |

FOREIGN PATENT DOCUMENTS

| | | |
|---|---|---|
| EP | 1 391 499 | 2/2004 |
| EP | 2 597 140 | 5/2013 |
| JP | 2000-204386 A | 7/2000 |
| JP | 2012-25801 A | 2/2012 |
| JP | 2012-82398 A | 4/2012 |
| JP | 2017-160407 A | 9/2017 |
| WO | WO 2015/045816 A1 | 4/2015 |

OTHER PUBLICATIONS

International Search Report dated May 14, 2019 in PCT/JP2019/007904 filed on Feb. 28, 2019, 2 pages.
Extended European Search Report in corresponding European Patent Application No. 19768456.6-1101/3766946 (PCT/JP2019007904) dated Aug. 25, 2021, 8 pages.

* cited by examiner

*Primary Examiner* — Ellen M McAvoy
(74) *Attorney, Agent, or Firm* — Oblon, McClelland, Maier & Neustadt, L.L.P.

(57) ABSTRACT

To provide a lubricating oil composition achieving both of high traction coefficient and excellent low temperature fluidity at a higher level and having a high flash point, which contains a naphthene-based synthetic oil (A) having a flash point of 140° C. or higher, a longifolene (B), and a predetermined monoester-based synthetic oil (C), a method for producing the lubricating oil composition, and a continuously variable transmission using the lubricating oil composition.

15 Claims, No Drawings

LUBRICATING OIL COMPOSITION, METHOD FOR PRODUCING LUBRICATING OIL COMPOSITION, AND CONTINUOUSLY VARIABLE TRANSMISSION

TECHNICAL FIELD

The present invention relates to a lubricating oil composition, a method for producing a lubricating oil composition, and a continuously variable transmission.

BACKGROUND ART

The transmission of the continuously variable transmission, especially the traction drive system, is smaller in size and lighter in weight than a transmission using a gear, and is capable of shifting without contact between metals, so that noise is hardly generated. Therefore, the transmission of the traction drive system is considered to be applied to an electric vehicle in particular.

The lubricating oil composition used in the transmission of the traction drive system requires low viscosity even under low temperature conditions (for example, about −40° C.), namely low temperature fluidity, in order to ensure low temperature startability in cold districts such as North America and North Europe, together with high traction coefficient under high temperature conditions (for example, about 120° C. for automotive applications), from the viewpoint of securing a large torque transmission capacity. However, since these performances are contradictory, it is difficult to achieve both. As a lubricating oil composition having such a performance, a lubricant base oil composition containing a naphthene-based synthetic lubricant base oil having a predetermined flash point and a paraffine-based synthetic lubricant base oil each at a predetermined content, and further a lubricant base oil composition containing a poly α-olefin have been proposed (for example, PTL 1).

CITATION LIST

Patent Literature

PTL 1: JP 2000-204386 A

SUMMARY OF INVENTION

Technical Problem

In recent years, required performance such as high traction coefficient and low temperature fluidity for lubricating oil compositions for use in continuously variable transmissions for automobiles, especially in the transmissions of the traction drive systems, has become increasingly severe, and the above-mentioned lubricant base oil compositions cannot be applicable in many cases. In addition to performance such as high traction coefficient and low temperature fluidity, a high flash point, for example, a flash point of 130° C. or higher is also required from the viewpoint of handling safety.

The present invention has been made in view of the above circumstances, and an object of the present invention is to provide a lubricating oil composition achieving both of high traction coefficient and excellent low temperature fluidity at a higher level and having a high flash point, a method for producing the lubricating oil composition, and a continuously variable transmission using the lubricating oil composition.

Solution to Problem

As a result of intensive studies in view of the above problems, the present inventors have found that the above problems can be solved by the following invention. That is, the present invention provides a lubricating oil composition having the following constitution, a method for producing the lubricating oil composition, and a continuously variable transmission using the lubricating oil composition.

1. A lubricating oil composition containing a naphthene-based synthetic oil (A) having a flash point of 140° C. or higher, a longifolene (B), and a monoester-based synthetic oil (C) represented by the following general formula (1):

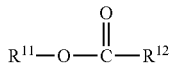

(1)

wherein $R^{11}$ and $R^{12}$ each independently represent a branched hydrocarbon group having 3 or more carbon atoms.

2. A method for producing a lubricating oil composition, including blending a naphthene-based synthetic oil (A) having a flash point of 140° C. or higher, a longifolene (B), and a monoester-based synthetic oil (C) represented by the general formula (1) described above.

3. A continuously variable transmission including a lubricating oil composition containing a naphthene-based synthetic oil (A) having a flash point of 140° C. or higher, a longifolene (B), and a monoester-based synthetic oil (C) represented by the general formula (1) described above.

Advantageous Effects of Invention

According to the present invention, it is possible to provide a lubricating oil composition achieving both of high traction coefficient and excellent low temperature fluidity at a higher level and having a high flash point, a method for producing the lubricating oil composition, and a continuously variable transmission using the lubricating oil composition.

DESCRIPTION OF EMBODIMENTS

An embodiment of the present invention (which may be hereinafter simply referred to as a "present embodiment") will be described below. In the description herein, the numerals with "or more", "or less", and "to" relating to the description of numerical ranges are numerical values that can be arbitrarily combined.

[Lubricating Oil Composition]

The lubricating oil composition of the present invention contains a naphthene-based synthetic oil (A) having a flash point of 140° C. or higher, a longifolene (B), and a monoester-based synthetic oil (C) represented by the following general formula (1). Hereinafter, each component that can be contained in the lubricating oil composition of the present embodiment will be specifically described.

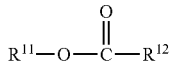

(1)

In the general formula (1), $R^{11}$ and $R^{12}$ each independently represent a branched hydrocarbon group having 3 or more carbon atoms.

(Naphthene-Based Synthetic Oil (A))

The lubricating oil composition of the present embodiment needs to contain a naphthene-based synthetic oil (A) having a flash point of 140° C. or higher (hereinafter sometimes referred to as a "naphthene-based synthetic oil (A)"). When the naphthene-based synthetic oil (A) is not contained, both of high traction coefficient and excellent low temperature fluidity cannot be achieved at a higher level, and a high flash point cannot be obtained.

In the lubricating oil composition of the present embodiment, the naphthene-based synthetic oil (A) is required to have a flash point of 140° C. or higher. When the flash point is less than 140° C., a particularly high traction coefficient cannot be obtained, and a lubricating oil composition having a high flash point cannot be obtained. In particular, from the viewpoint of improving the traction coefficient and the flash point, the flash point of the naphthene-based synthetic oil (A) is preferably 145° C. or higher, more preferably 150° C. or higher, and still more preferably 160° C. or higher, and the upper limit thereof is not particularly limited, but may be about 200° C. or lower. In the description herein, the flash point is a flash point measured by Cleveland open-cup method in accordance with JIS K2265-4:2007 (Determination of flash point-Part 4: Cleveland open-cup method).

The naphthene-based synthetic oil (A) used in the lubricating oil composition of the present embodiment is not particularly limited as long as it has a flash point of 140° C. or higher, but is preferably a synthetic oil having a cyclic structural portion from the viewpoint of improving the traction coefficient and the flash point, and more preferably a synthetic oil having at least one ring selected from a cyclohexane ring, a bicycloheptane ring, and a bicyclooctane ring. Examples of such a naphthene-based synthetic oil (A) include a synthetic oil represented by the following general formula (2).

$$R^{21}{}_{p21}—X_{21}—R^{22}—X_{22}—R^{23}{}_{p22} \quad (2)$$

In the general formula (2), $R^{21}$ and $R^{23}$ each independently represent a hydrocarbon group, $R^{22}$ represents a hydrocarbon group, $X_{21}$ and $X_{22}$ each independently represent a cyclohexane ring, a bicycloheptane ring, or a bicyclooctane ring, and $p_{21}$ and $p_{22}$ each independently represent an integer of 1 or more and 6 or less.

Examples of the hydrocarbon group represented by $R^{21}$ and $R^{23}$ include monovalent hydrocarbon groups such as an alkyl group, an alkenyl group, a cycloalkyl group, and an aryl group. Among these monovalent hydrocarbon groups, an alkyl group and an alkenyl group are preferable, and an alkyl group is more preferable from the viewpoint of improving the traction coefficient and the flash point. Moreover, these monovalent hydrocarbon groups may be linear structure, branched structure, or cyclic structure, and may have a substituent such as a halogen atom or a hydroxy group, and when the monovalent hydrocarbon group is a cycloalkyl group or an aryl group, it may further have a substituent such as an alkyl group.

From the same viewpoint, the number of carbon atoms of the monovalent hydrocarbon group is preferably 1 or more and the upper limit thereof is preferably 12 or less, more preferably 8 or less, still more preferably 4 or less, and particularly preferably 2 or less when the monovalent hydrocarbon is an alkyl group, and it is preferably 2 or more and more preferably 3 or more, and the upper limit is preferably 12 or less, more preferably 8 or less, and still more preferably 4 or less when the monovalent hydrocarbon is an alkenyl group.

$p_{21}$ and $p_{22}$ are each independently an integer of 1 or more and 6 or less, and the upper limit is preferably 4 or less, more preferably 3 or less, and still more preferably 2 or less from the viewpoints of achieving both of high traction coefficient and excellent low temperature fluidity at a higher level and improving the flash point.

Examples of the hydrocarbon group represented by $R^{22}$ include a divalent hydrocarbon group obtained by removing one hydrogen atom from the monovalent hydrocarbon group represented by $R^{21}$ and $R^{23}$ to form a divalent, and an alkylene group and an alkenylene group are preferable, and an alkylene group is more preferable from the viewpoint of improving the traction coefficient and the flash point.

In addition, from the viewpoints of achieving both of high traction coefficient and excellent low temperature fluidity at a higher level and improving the flash point, the number of carbon atoms of the divalent hydrocarbon group represented by $R^{22}$ is 1 or more, and the upper limit thereof is preferably 12 or less, more preferably 8 or less, and still more preferably 4 or less.

As the ring of $X_{21}$ and $X_{22}$, from the viewpoint of improving the traction coefficient and the flash point, a bicycloheptane ring and a bicyclooctane ring are preferable, and a bicycloheptane ring is more preferable.

Examples of the bicycloheptane ring include a bicyclo[2.2.1]heptane ring, a bicyclo[4.1.0]heptane ring, and a bicyclo[3.2.0]heptane ring. Examples of the bicyclooctane ring include a bicyclo[3.2.1]octane ring, a bicyclo[2.2.2]octane ring, and a bicyclo[3.3.0]octane ring. Among these, from the viewpoint of improving the traction coefficient and the flash point, a bridged bicyclic ring in which two rings are bonded to each other by sharing 3 or more carbon atoms is preferable, a bicyclo[2.2.1]heptane ring, a bicyclo[3.2.1]octane ring, and a bicyclo[2.2.2]octane ring are more preferable, and a bicyclo[2.2.1]heptane ring is particularly preferable.

Further, these rings may have a monovalent hydrocarbon group represented by $R^{21}$ and $R^{23}$, and may have a substituent such as a hydroxy group and a halogen atom.

In the present embodiment, among the above, from the viewpoint of improving the traction coefficient and the flash point, it is preferable that $R^{21}$ and $R^{23}$ are each independently an alkyl group or an alkenyl group, and $R^{22}$ is an alkylene group or an alkenylene group, it is more preferable that $R^{21}$ and $R^{23}$ are each independently an alkyl group having 1 to 4 carbon atoms, $R^{22}$ is an alkylene group having 1 to 4 carbon atoms, and $p_{21}$ and $p_{22}$ are each independently 1 or 2, it is still more preferable that $R^{21}$ and $R^{23}$ are each independently an alkyl group having 1 to 4 carbon atoms, $R^{22}$ is an alkylene group having 1 to 4 carbon atoms, $X_{21}$ and $X_{22}$ are a bicycloheptane ring, and $p_{21}$ and $p_{22}$ are each independently 1 or 2, and it is particularly preferable that $R^{21}$ and $R^{23}$ are each independently an alkyl group having 1 to 2 carbon atoms, $R^{22}$ is an alkylene group having 1 to 2 carbon atoms, $X_{21}$ and $X_{22}$ are a bicyclo[2.2.1]heptane ring, and $p_{21}$ and $p_{22}$ are each independently 1 or 2.

The content of the naphthene-based synthetic oil (A) based on the total amount of the composition is preferably 20% by mass or more, more preferably 25% by mass or more, and still more preferably 30% by mass or more from the viewpoint of improving the traction coefficient and the flash point, and the upper limit thereof is preferably 45% by mass or less, more preferably 40% by mass or less, and still more preferably 35% by mass or less from the viewpoint of achieving more excellent low temperature fluidity. Further, in the present embodiment, the naphthene-based synthetic oil (A) may be used alone or in combination of two or more kinds thereof, and when a plurality thereof are used in combination, the total content of the plural naphthene-based synthetic oils (A) may fall within the range of the above-mentioned content.

(Longifolene (B))

The lubricating oil composition of the present embodiment needs to contain a longifolene (B). If the longifolene (B) is not contained, high traction coefficient and excellent low temperature fluidity cannot be obtained, and these properties cannot be achieved at a higher level.

The longifolene (B) is a compound having at least a ring structure in which a cycloheptane ring and a bicyclo[2.2.1] heptane ring are bonded to each other by sharing 3 carbon atoms, and a hydrocarbon group linked to one of the carbon atoms forming the ring structure via a double bond, and more specifically, (1S,3aR,4S,8aS)-4,8,8-trimethyl-9-methylene-decahydro-1,4-methanoazulene represented by the following chemical formula (3). In the present embodiment, the longifolene includes, in addition to the compound represented by the chemical formula (3), isomers of the compound, and further includes, for example, compounds optionally having a hydrocarbon group such as an alkyl group having 1 to 4 carbon atoms, a substituent such as a halogen atom, and the like.

(3)

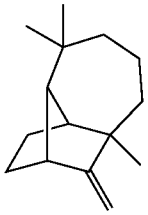

In the chemical formula (3), the hydrocarbon group linked via a double bond may be a divalent hydrocarbon group such as an alkylidene group, an alkenylidene group, or a cycloalkylidene group. From the viewpoint of achieving both of high traction coefficient and excellent low temperature fluidity at a higher level, an alkylidene group is preferable, the number of carbon atoms is preferably 1 or more and 4 or less, and a methylidene group having one carbon atom as shown in the chemical formula (3) is particularly preferable. The hydrocarbon group linked via a double bond may further have a substituent such as a halogen atom, a hydroxy group, and in the case of a cycloalkylidene group, an alkyl group or the like.

The longifolene (B) is mainly contained in essential oils such as pine and cypress, and these essential oils may be used in the present embodiment. However, since the content of the longifolene contained in these essential oils is usually 5 to 10% by mass, it is preferable to use purified longifolene obtained by purification and having a content of preferably 60% by mass or more, more preferably 70% by mass or more, still more preferably 80% by mass or more, and particularly preferably 90% by mass or more from the viewpoint of the effect of use. The upper limit of the content of longifolene in the purified longifolene is preferably 100% by mass because the higher the content, the more preferable, but is preferably 98% by mass or less from the viewpoint of efficiently obtaining the effect obtained by using longifolene. In addition, in the present embodiment, longifolene obtained by synthesis can also be used.

The purified longifolene that can be used in the present embodiment may contain β-caryophyllene mainly contained in pine, cypress, and the like as a component other than longifolene. β-Caryophyllene is (1R,4E,9S)-4,11,11-trimethyl-8-methylene-bicyclo[7.2.0]undec-4-ene, which is represented by the following chemical formula. In the present embodiment, components other than longifolene such as β-caryophyllene may be contained as long as the effects of the present invention are not impaired. Specifically, components other than longifolene may be contained as long as the content of longifolene contained in the purified longifolene falls within the above range.

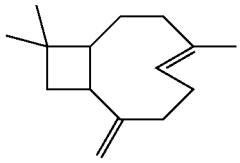

The content of the longifolene (B) (pure longifolene) based on the total amount of the composition is preferably 15% by mass or more, more preferably 20% by mass or more, and still more preferably 25% by mass or more from the viewpoint of achieving both of high traction coefficient and excellent low temperature fluidity at a higher level, and the upper limit is preferably 40% by mass or less, more preferably 37% by mass or less, and still more preferably 35% by mass or less from the viewpoint of improving the flash point. In addition, in the present embodiment, the longifolene (B) may be used alone or in combination of two or more kinds including the longifolene as shown in the above chemical formula (3) and isomers of the longifolene, and when a plurality of kinds are used in combination, the total content of the plural kinds of longifolene (B) may be within the above-described range of the content.

(Monoester-Based Synthetic Oil (C) Represented by General Formula (1))

The lubricating oil composition of the present embodiment needs to contain a monoester-based synthetic oil (C) represented by the following general formula (1) (hereinafter sometimes referred to as a "monoester-based synthetic oil (C)"). When the monoester-based synthetic oil (C) is not contained, a high flash point cannot be obtained, the handling safety of the lubricating oil composition of the present embodiment is reduced, and particularly the low temperature fluidity is reduced, and both of high traction coefficient and excellent low temperature fluidity cannot be achieved at a higher level.

(1)

$$R^{11}-O-\overset{\overset{\displaystyle O}{\|}}{C}-R^{12}$$

In the general formula (1), $R^{11}$ and $R^{12}$ each independently represent a branched hydrocarbon group having 3 or more carbon atoms.

Examples of the branched monovalent hydrocarbon group having 3 or more carbon atoms represented by $R^{11}$ and $R^{12}$ include a branched group having 3 or more carbon atoms among the groups exemplified as the monovalent hydrocarbon group represented by $R^{21}$ and $R^{23}$ described above. Among them, a branched alkyl group and a branched alkenyl group are preferable, and a branched alkyl group is more preferable from the viewpoint of achieving both of high traction coefficient and excellent low temperature fluidity at a higher level. In addition, the number of carbon atoms is preferably 4 or more, more preferably 5 or more, and still more preferably 6 or more, and the upper limit thereof is preferably 16 or less, more preferably 14 or less, and still more preferably 12 or less from the viewpoints of achieving both of high traction coefficient and excellent low temperature fluidity at a higher level and improving the flash point.

The monovalent hydrocarbon group represented by $R^{11}$ and $R^{12}$ is preferably a branched group having a gem-dialkyl structure from the viewpoints of achieving both of high traction coefficient and excellent low temperature fluidity at a higher level and improving the flash point. In this case, the number of carbon atoms in the alkyl group in the gem-dialkyl structure is preferably 1 or more, and the upper limit thereof is preferably 4 or less, more preferably 3 or less, and still more preferably 2 or less, and the number of carbon atoms in the two alkyl groups may be the same or different. A particularly preferred gem-dialkyl structure is a gem-dimethyl structure in which the number of carbon atoms in the alkyl group in the structure is 1.

Typical specific examples of the monovalent hydrocarbon group represented by $R^{11}$ and $R^{12}$ preferably include an isopropyl group, a 1,1-dimethylethyl group, a 2,2-dimethylpropyl group, a 3,3-dimethylbutyl group, a 4,4-dimethylpentyl group, a 5,5-dimethylhexyl group, a 2,4,4-trimethylpentyl group, a 3,5,5-trimethylhexyl group, a 2,2,4,4,6-pentamethylheptyl group, a 2,2,4,6,6-pentamethylheptyl group, and a 3,5,5,7,7-pentamethyloctyl group, and among these, a 2,4,4-trimethylpentyl group and a 3,5,5-trimethylhexyl group are preferable. It is needless to say that these monovalent hydrocarbon groups are exemplified by typical examples, and in the present embodiment, the isomers of the hydrocarbon group described above may be used as $R^{11}$ and $R^{12}$.

The number of carbon atoms of the monoester-based synthetic oil (C) is preferably 8 or more, more preferably 12 or more, and still more preferably 16 or more, and the upper limit thereof is preferably 30 or less, more preferably 25 or less, and still more preferably 21 or less from the viewpoints of achieving both of high traction coefficient and excellent low temperature fluidity at a higher level and improving the flash point.

The content of the monoester-based synthetic oil (C) based on the total amount of the composition is preferably 10% by mass or more, more preferably 15% by mass or more, still more preferably 20% by mass or more, and particularly preferably 25% by mass or more from the viewpoints of achieving excellent low temperature fluidity and improving the flash point, and the upper limit is preferably 40% by mass or less, more preferably 35% by mass or less, still more preferably 30% by mass or less, and particularly preferably 28% by mass or less from the viewpoint of achieving higher traction coefficient. In the present embodiment, the monoester-based synthetic oil (C) may be used alone or in combination of two or more kinds thereof, and when a plurality thereof are used in combination, the total content of the plural monoester-based synthetic oil (C) may fall within the range of the above-mentioned content.

(Other Additives)

The lubricating oil composition of the present embodiment contains the naphthene-based synthetic oil (A), the longifolene (B), and the monoester-based synthetic oil (C) and may be composed of the naphthene-based synthetic oil (A), the longifolene (B), and the monoester-based synthetic oil (C), or may contain other additives such as a viscosity index improver, a dispersant, an antioxidant, an extreme pressure agent, a metal deactivator, and an anti-foaming agent besides the naphthene-based synthetic oil (A), the longifolene (B), and the monoester-based synthetic oil (C). These other additives may be used alone or in combination of two or more kinds thereof.

The total content of these other additives may be appropriately determined as desired, and is not particularly limited, but is preferably 0.1 to 20% by mass, more preferably 1 to 15% by mass, and still more preferably 5 to 13% by mass, based on the total amount of the composition, in consideration of the effect of adding other additives.

Examples of the viscosity index improver include polymetacrylates such as a non-dispersion type polymethacrylate or a dispersion type polymethacrylate having a mass average molecular weight (Mw) of preferably 500 to 1,000,000 and more preferably 5,000 to 800,000; and polymers such as an olefinic copolymer (e.g., an ethylene-propylene copolymer), a dispersant-type olefinic copolymer, and a styrenic copolymer (e.g., a styrene-diene copolymer, a styrene-isoprene copolymer) having a mass average molecular weight (Mw) of preferably 800 to 300,000 and more preferably 10,000 to 200,000.

Examples of the dispersant include ash-free dispersants such as boron-free succinimides, boron-containing succinimides, benzylamines, boron-containing benzylamines, succinic esters, and amides of monovalent or divalent carboxylic acid represented by fatty acids or succinic acids.

Examples of the antioxidant include amine-based antioxidants such as diphenylamine-based antioxidants and naphthylamine-based antioxidants; phenol-based antioxidants such as monophenol-based antioxidants, diphenol-based antioxidants, and hindered phenol-based antioxidants; molybdenum-based antioxidants such as molybdenum amine complexes obtained by reacting molybdenum trioxide and/or molybdic acid with an amine compound.

Examples of the extreme pressure agent include sulfur-type extreme pressure agents such as sulfurized oils and fats, sulfurized fatty acids, sulfurized esters, sulfurized olefins, dihydrocarbyl polysulfides, thiadiazole compounds, alkylthiocarbamoyl compounds, and thiocarbamate compounds; phosphorus-based extreme pressure agents such as phosphate, phosphite, acid phosphate, acid phosphite, and amine salt thereof; and sulfur-phosphorus-based extreme pressure agents such as zinc dialkylthiocarbamate (Zn-DTC), molybdenum dialkylthiocarbamate (Mo-DTC), zinc dialkyldithiophosphate (Zn-DTP), and molybdenum dialkyldithiophosphate (Mo-DTP).

Examples of the metal deactivator include benzotriazole type, tolyltriazole type, thiadiazole type, and imidazole type compounds. Examples of the anti-foaming agent include silicone-based anti-foaming agents such as silicone oil and fluorosilicone oil, and ether-based anti-foaming agents such as fluoroalkyl ether.

(Various Physical Properties of Lubricating Oil Composition)

The kinematic viscosity at 40° C. of the lubricating oil composition of the present embodiment is preferably 3 $mm^2/s$ or more and 50 $mm^2/s$ or less, more preferably 5 $mm^2/s$ or more and 30 $mm^2/s$ or less, and still more preferably 10 $mm^2/s$ or more and 20 $mm^2/s$ or less from the viewpoints of preventing seizure at high temperature and ensuring low temperature fluidity. From the same viewpoint, the kinematic viscosity at 100° C. of the lubricating oil composition of the present embodiment is preferably 0.5 $mm^2/s$ or more and 15 $mm^2/s$ or less, more preferably 1 $mm^2/s$ or more and 10 $mm^2/s$ or less, and still more preferably 1.5 $mm^2/s$ or more and 5 $mm^2/s$ or less. Further, the viscosity index of the lubricating oil composition of the present embodiment is preferably 75 or more, more preferably 80 or more, and still more preferably 85 or more.

In the description herein, the kinematic viscosity and the viscosity index are values measured by using a glass capillary type viscometer in accordance with JIS K2283:2000.

The Brookfield viscosity (BF viscosity) at −40° C. of the lubricating oil composition of the present embodiment is preferably 3,000 mPa·s or less, more preferably 2,800 mPa·s or less, still more preferably 2,600 mPa·s or less, and particularly preferably 2,400 mPa·s or less. In this manner, the lubricating oil composition of the present embodiment has a low Brookfield viscosity (BF viscosity) at −40° C. and excellent low temperature fluidity.

In the description herein, the Brookfield viscosity (BF viscosity) at −40° C. is measured in accordance with ASTM D2983-09.

In the lubricating oil composition of the present embodiment, the flash point is measured by Cleveland open-cup method in accordance with JIS K2265-4:2007 and is preferably 130° C. or higher, more preferably 135° C. or higher, and still more preferably 140° C. or higher. In this manner, the lubricating oil composition of the present embodiment has a high flash point, a high flame retardancy, and a high safety.

Further, the traction coefficient at 120° C. of the lubricating oil composition of the present embodiment is preferably 0.050 or more, more preferably 0.051 or more, and still more preferably 0.052 or more. In this manner, the lubricating oil composition of the present embodiment has a high traction coefficient at 120° C., which achieves both of high traction coefficient and excellent low temperature fluidity at a higher level and has a high flash point.

In the description herein, the traction coefficient at 120° C. is a value measured by using a traction coefficient measuring instrument (product name: MTM2 (Mini Traction Machine 2, manufactured by PCS Instruments). Here, the measurement conditions for the traction coefficient at 120° C. are as follows. First, by heating an oil tank with a heater, the oil temperature was set to 140° C., and the traction coefficient at a load of 70N, an average rolling speed of 3.8 m/s, and a slip rate of 5% was measured.

(Use of Lubricating Oil Composition)

The lubricating oil composition of the present embodiment can be suitably used for continuously variable transmissions, continuously variable speed increasers, and continuously variable speed reducers, especially for continuously variable transmission applications. Examples of the continuously variable transmission include a metal belt system, a chain system, and a traction drive system, which are required to have high transmission efficiency and a lubricating oil having a high traction coefficient. In this regard, the lubricating oil composition of the present embodiment can be suitably used for a continuously variable transmission of any type, and in particular, can be suitably used in a transmission of a traction drive system.

Further, since the lubricating oil composition of the present embodiment is excellent in traction coefficient, particularly traction coefficient at high temperature and low temperature fluidity, it can be suitably used as a transmission fluid for a continuously variable transmission in an automobile and an air engine generator, especially for a traction drive system. In addition to the above, the present invention can also be suitably applied to continuously variable transmissions for industrial applications such as a drive unit for a construction machine or an agricultural machine, and a speed increaser for wind power generation, and also to a continuously variable speed increaser and a continuously variable speed reducer.

[Method for Producing Lubricating Oil Composition]

A method for producing a lubricating oil composition of the present embodiment includes blending a naphthene-based synthetic oil (A) having a flash point of 140° C. or higher, a longifolene (B), and a monoester-based synthetic oil (C) represented by the following general formula (1).

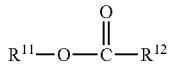

(1)

In the general formula (1), $R^{11}$ and $R^{12}$ each independently represent a branched hydrocarbon group having 3 or more carbon atoms.

In the method for producing a lubricating oil composition of the present embodiment, the naphthene-based synthetic oil (A) having a flash point of 140° C. or higher, the longifolene (B), and the monoester-based synthetic oil (C) are the same as those described as the naphthene-based synthetic oil (A), the longifolene (B), and the monoester-based synthetic oil (C) contained in the lubricating oil composition of the present embodiment, and the contents of the naphthene-based synthetic oil (A), the longifolene (B), and the monoester-based synthetic oil (C) are also the same as those described as the contents of the lubricating oil composition of the present embodiment. Further, in the method for producing a lubricating oil composition of the present embodiment, components other than the naphthene-based synthetic oil (A), the longifolene (B), and the monoester-based synthetic oil (C), for example, additives such as those described above which may be included in the lubricating oil composition of the present embodiment, may be blended.

In the production of the lubricating oil composition, the blending order of the naphthene-based synthetic oil (A), the longifolene (B), and the monoester-based synthetic oil (C) is not particularly limited, and the longifolene (B) and the monoester-based synthetic oil (C) may be added to the naphthene-based synthetic oil (A) simultaneously or sequentially, or, for example, a mixture obtained by blending the longifolene (B) and the monoester-based synthetic oil (C) in advance may be added to the naphthene-based synthetic oil (A). Moreover, when blending other additives, various additives used as other additives may be sequentially blended into a mixture of the naphthene-based synthetic oil (A), the longifolene (B), and the monoester-based synthetic oil (C), or the various additives may be blended in advance before blending the above (A), (B), and (C).

[Continuously Variable Transmission]

The continuously variable transmission of the present embodiment includes using a lubricating oil composition which contains a naphthene-based synthetic oil (a) having a flash point of 140° C. or higher, a longifolene (B), and a monoester-based synthetic oil (C) represented by the following general formula (1). The lubricating oil composition used in the continuously variable transmission of the present embodiment is the same as that described as the lubricating oil composition of the present embodiment.

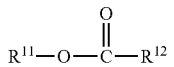

(1)

In the general formula (1), $R^{11}$ and $R^{12}$ each independently represent a branched hydrocarbon group having 3 or more carbon atoms.

The continuously variable transmission includes a metal belt system, a chain system, a traction drive system, and the like, which may be a continuously variable transmission of any system, and has a feature that a lubricating oil composition used achieves both of high traction coefficient and excellent low temperature fluidity at a higher level and has a high flash point, and is preferably a continuously variable transmission of a traction drive system from the viewpoint of utilizing the feature more effectively.

EXAMPLES

The present invention will be described in more detail with reference to examples below, but the present invention is not limited to the examples.

The properties and performance of the lubricating oil composition were measured in the following manner.

(1) Kinematic Viscosity

The kinematic viscosity at 40° C. and 100° C. was measured in accordance with JIS K 2283:2000.

(2) Viscosity Index (VI)

The viscosity index was obtained in accordance with JIS K 2283:2000.

(3) Traction Coefficient at 120° C.

The traction coefficient was measured by using the traction coefficient measuring instrument (product name: MTM2 (Mini Traction Machine 2, manufactured by PCS Instruments) under the following conditions. If it is equal to or greater than 0.050, it is acceptable.

Heating condition of oil temperature: 140° C.

Load: 70N

Average rolling speed: 3.8 m/s

Slip rate: 5%

(4) Brookfield Viscosity at −40° C.

The Brookfield viscosity (BF viscosity) at −40° C. was measured in accordance with ASTM D2983-09. If it is equal to or less than 3,000 mPa·s, it is acceptable.

(5) Flash Point

The flash point was measured by Cleveland open-cup method in accordance with JIS K2265-4:2007 (Determination of flash point-Part 4: Cleveland open-cup method). If it is equal to or higher than 130° C., it is acceptable.

Preparation of Lubricating Oil Compositions of Example 1 and Comparative Examples 1 to 6

Lubricating oil compositions were prepared by blending according to the blending formulation shown in Table 1 below. The evaluation results of properties and performance measured by the above methods for the obtained lubricating oil compositions are shown in Table 1.

The naphthene-based synthetic oil, longifolene, and ester-based synthetic oil shown in Table 1 used in these examples are those represented by the following chemical formulas.

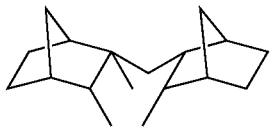

Naphthene-based synthetic oil

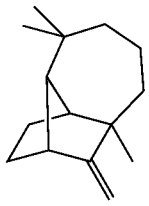

Longifolene

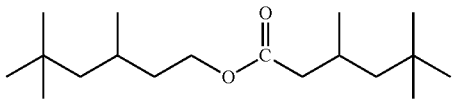

Ester-based synthetic oil

Naphthene-based synthetic oil: a naphthene-based synthetic oil shown in the above chemical formula and represented by the general formula (2), in which $R^{21}$ and $R^{23}$ are a methyl group, $R^{22}$ is a methylene group, $X_{21}$ and $X_{22}$ are a bicyclo[2.2.1]heptane ring, $p_{21}$ is 2, and $p_{22}$ is 1.

Longifolene mixture: a mixture of (1S,3aR,4S,8aS)-4,8,8-trimethyl-9-methylene-decahydro-1,4-methanoazulene (92% by mass) shown in the above chemical formula and β-caryophyllene or the like.

Monoester-based synthetic oil: a monoester shown in the above chemical formula and represented by the general formula (1), in which $R^{11}$ is a 3,5,5-trimethylhexyl group and $R^{12}$ is a 2,4,4-trimethylpentyl group.

Additives: viscosity index improver, dispersant (succinimide), antioxidant, extreme pressure agent (sulfur-phosphorus), metal deactivator, and anti-foaming agent

TABLE 1

| | | | Example | Comparative Example | | | | | |
|---|---|---|---|---|---|---|---|---|---|
| | | | 1 | 1 | 2 | 3 | 4 | 5 | 6 |
| Blending formulation | (A) Naphthene-based synthetic oil | % by mass | 33.3 | 33.3 | 26.8 | 21.8 | 51.8 | 41.8 | 33.3 |
| | (B) Longifolene mixture | % by mass | 32.5 | 58.5 | 65.0 | 70.0 | — | — | — |
| | (Pure Longifolene) | % by mass | 29.9 | 53.8 | 59.8 | 64.4 | — | — | — |
| | (C) Monoester-based synthetic oil | % by mass | 26.0 | — | — | — | 40.0 | 50.0 | 58.5 |
| | Additives | % by mass | 8.2 | 8.2 | 8.2 | 8.2 | 8.2 | 8.2 | 8.2 |
| | Total | % by mass | 100.0 | 100.0 | 100.0 | 100.0 | 100.0 | 100.0 | 100.0 |
| Properties, performance | Kinematic viscosity at 40° C. | $mm^2/s$ | 12.6 | 16.3 | 15.3 | 14.3 | 13.4 | 11.2 | 9.68 |
| | Kinematic viscosity at 100° C. | $mm^2/s$ | 3.32 | 3.94 | 3.81 | 3.67 | 3.39 | 3.06 | 2.80 |
| | Viscosity index | — | 140 | 139 | 146 | 148 | 129 | 135 | 141 |
| | Traction coefficient | — | 0.053 | 0.068 | 0.068 | 0.065 | 0.050 | 0.046 | 0.036 |
| | Brookfield viscosity | mPa · s | 2,020 | 3,400 | 2,440 | 1,790 | 4,030 | 2,100 | 1,300 |
| | Flash point | ° C. | 142 | 124 | 118 | 114 | 150 | 146 | 148 |

From the results shown in Table 1, it was confirmed that the lubricating oil compositions of the present embodiment each has a traction coefficient of 0.050 or more, a Brookfield viscosity at −40° C. of 3,000 mPa·s or less, and a flash point of 130° C. or higher, so that the lubricating oil compositions achieve both of high traction coefficient and excellent low temperature fluidity at a higher level, and have a high flash point.

On the other hand, in Comparative Example 1 to 3 not containing the monoester-based synthetic oil (C), the lubricating oil composition of Comparative Example 1 had a high Brookfield viscosity of 3400 mPa·s and a low flash point of 124° C., and the lubricating oil compositions of Comparative Examples 2 and 3 had flash points of 118° C. and 114° C., respectively, which did not reach 130° C. In addition, in Comparative Examples 4 to 6 not containing the longifolene (B), the lubricating oil composition of Comparative Example 4 had a high Brookfield viscosity of 4030 mPa·s, and the lubricating oil compositions of Comparative Examples 5 and 6 had low traction coefficients of 0.046 and 0.036, respectively. As described above, all of the lubricating oil compositions of Comparative Examples could not be said to achieve both of high traction coefficient and excellent low temperature fluidity at a higher level and to have a high flash point.

The invention claimed is:

1. A lubricating oil composition comprising a naphthene-based synthetic oil (A) having a flash point of 140° C. or higher, a longifolene (B), and a monoester-based synthetic oil (C) represented by the following general formula (1):

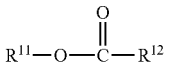

(1)

wherein $R_{11}$ and $R^{12}$ each independently represent a branched hydrocarbon group having 3 or more carbon atoms and wherein the content of the naphthene-based synthetic oil (A) based on the total amount of the composition is 20% by mass or more and 45% by mass or less.

2. The lubricating oil composition according to claim 1, wherein the naphthene-based synthetic oil (A) is a synthetic oil having at least one ring selected from a cyclohexane ring, a bicycloheptane ring, and a bicyclooctane ring.

3. The lubricating oil composition according to claim 1, wherein the naphthene-based synthetic oil (A) is a synthetic oil represented by the following general formula (2):

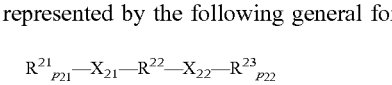

$$R^{21}{}_{p21}—X_{21}—R^{22}—X_{22}—R^{23}{}_{p22} \quad (2)$$

wherein $R^{21}$ and $R^{23}$ each independently represent a hydrocarbon group, $R^{22}$ represents a hydrocarbon group, $X_{21}$ and $X_{22}$ each independently represent a cyclohexane ring, a bicycloheptane ring, or a bicyclooctane ring, and $p_{21}$ and $p_{22}$ each independently represent an integer of 1 or more and 6 or less.

4. The lubricating oil composition according to claim 3, wherein in the general formula (2), $X_{21}$ and $X_{22}$ are each independently a cyclohexane ring, a bicyclo[2.2.1]heptane ring, a bicyclo[3.2.1]octane ring, or a bicyclo[2.2.2]octane ring.

5. The lubricating oil composition according to claim 3, wherein in the general formula (2), $R^{21}$ and $R^{23}$ each independently represent an alkyl group or an alkenyl group, and $R^{22}$ represents an alkylene group or an alkenylene group.

6. The lubricating oil composition according to claim 3, wherein in the general formula (2), $R^{21}$ and $R^{23}$ each independently represent an alkyl group having 1 to 4 carbon atoms, $R^{22}$ represents an alkylene group having 1 to 4 carbon atoms, and $p_{21}$ and $p_{22}$ each independently represent 1 or 2.

7. The lubricating oil composition according to claim 3, wherein in the general formula (2), $R^{21}$ and $R^{23}$ each independently represent an alkyl group having 1 to 2 carbon atoms, $R^{22}$ represents an alkylene group having 1 to 2 carbon atoms, $X_{21}$ and $X_{22}$ are a bicyclo[2.2.1]heptane ring, and $p_{21}$ and $p_{22}$ each independently represent 1 or 2.

8. The lubricating oil composition according to claim 1, wherein in the general formula (1), $R^{11}$ and $R^{12}$ each independently represent a branched alkyl group or alkenyl group having 4 to 16 carbon atoms.

9. The lubricating oil composition according to claim 1, wherein in the general formula (1), $R^{11}$ and $R^{12}$ each independently represent a branched alkyl group having 3 to 16 carbon atoms and having a gem-dialkyl structure.

10. The lubricating oil composition according to claim 1, wherein the content of the longifolene (B) based on the total amount of the composition is 15% by mass or more and 45% by mass or less, and the content of the monoester-based synthetic oil (C) based on the total amount of the composition is 10% by mass or more and 40% by mass or less.

11. The lubricating oil composition according to claim 1, wherein the lubricating oil composition has a Brookfield viscosity at −40° C., measured in accordance with ASTM D2983-09, of 3,000 mPa·s or less.

12. The lubricating oil composition according to claim 1, wherein the lubricating oil composition has a flash point as measured by Cleveland open-cup method in accordance with MS K2265-4:2007, of 130° C. or higher.

13. The lubricating oil composition according to claim 1, which is used in a continuously variable transmission.

14. A method for producing a lubricating oil composition, comprising blending a naphthene-based synthetic oil (A) having a flash point of 140° C. or higher, a longifolene (B), and a monoester-based synthetic oil (C) represented by the following general formula (1):

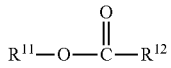

(1)

wherein $R^{11}$ and $R^{12}$ each independently represent a branched hydrocarbon group having 3 or more carbon atoms, and wherein in the composition, the content of the naphthene-based synthetic oil (A) based on the total amount of the composition is 20% by mass or more and 45% by mass or less.

15. A continuously variable transmission comprising a lubricating oil composition containing a naphthene-based synthetic oil (A) having a flash point of 140° C. or higher, a longifolene (B), and a monoester-based synthetic oil (C) represented by the following general formula (1):

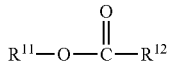

(1)

wherein $R^{11}$ and $R^{12}$ each independently represent a branched hydrocarbon group having 3 or more carbon atoms, and wherein in the composition, the content of the naphthene-based synthetic oil (A) based on the total amount of the composition is 20% by mass or more and 45% by mass or less.

* * * * *